United States Patent [19]

Kasper et al.

[11] 4,436,359

[45] Mar. 13, 1984

[54] ELECTRICAL CONNECTOR TERMINATION SYSTEM FOR QUICK FIELD SERVICE

[75] Inventors: Alan H. Kasper; Istvan Mathe, both of Cicero, Ill.

[73] Assignee: Allied Corporation, Morris Township, Morris County, N.J.

[21] Appl. No.: 842,186

[22] Filed: Oct. 14, 1977

[51] Int. Cl.[3] ..... H01R 13/422; H01R 13/627

[52] U.S. Cl. ..... 339/61 M; 339/63 M; 339/195 M; 339/278 M

[58] Field of Search ..... 339/59 R, 59 M, 61 R, 339/61 M, 91 R, 97 C, 176 M, 198 R, 198 P, 198 S, 205, 217 S, 242, 63 M, 195 M, 278 M

[56] References Cited

U.S. PATENT DOCUMENTS

| | | | |
|---|---|---|---|
| 2,401,430 | 6/1946 | Lake | 339/198 P |
| 2,760,174 | 8/1956 | Burtt et al. | 339/91 R |
| 3,177,464 | 4/1965 | Solorow et al. | 339/217 S |
| 3,383,644 | 5/1968 | Nava et al. | 339/242 |
| 3,696,322 | 10/1972 | Spangler et al. | 339/97 C |

FOREIGN PATENT DOCUMENTS

| | | | |
|---|---|---|---|
| 945482 | 1/1964 | United Kingdom | 339/61 R |
| 1070926 | 6/1967 | United Kingdom | 339/59 M |
| 1393059 | 5/1975 | United Kingdom | 339/198 R |

*Primary Examiner*—Neil Abrams
*Attorney, Agent, or Firm*—Roger H. Criss

[57] ABSTRACT

An electrical connector termination system includes a connector component having a plurality of ribbon contact members mounted within individual cavities, each ribbon contact member including a terminal socket element disposed proximate its mounting cavity's outer end. A termination component is provided having at least one pin contact member. Each pin contact member includes a terminal portion electrically engaged to at least one electrical conductor, and an active pin portion adapted for electrically and mechanically terminating with the socket element of one ribbon contact member. Keying and locking means are also provided for aligning and releasably maintaining the connector and termination components in a fully terminated condition and include a narrowed channel disposed adjacent each cavity's outer end which defines a restrictive guide orifice, at least one neck portion disposed about each pin contact member intermediate its terminal and active pin portions, and means lockingly engaging at least one neck portion of each pin contact member for retaining the pin contact members within the terminated connector.

9 Claims, 16 Drawing Figures

FIG. 1
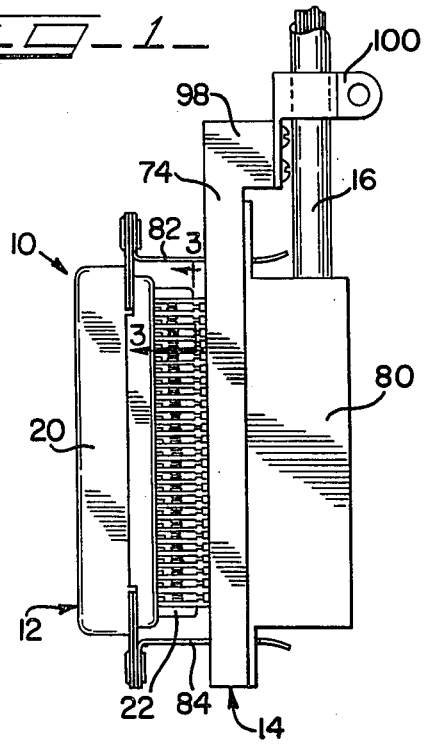
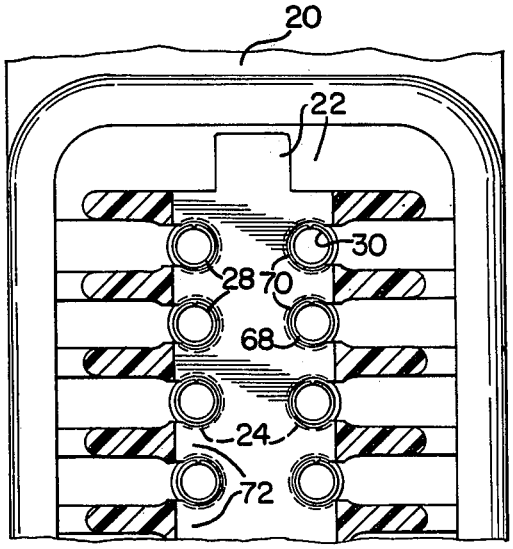
FIG. 3
FIG. 2
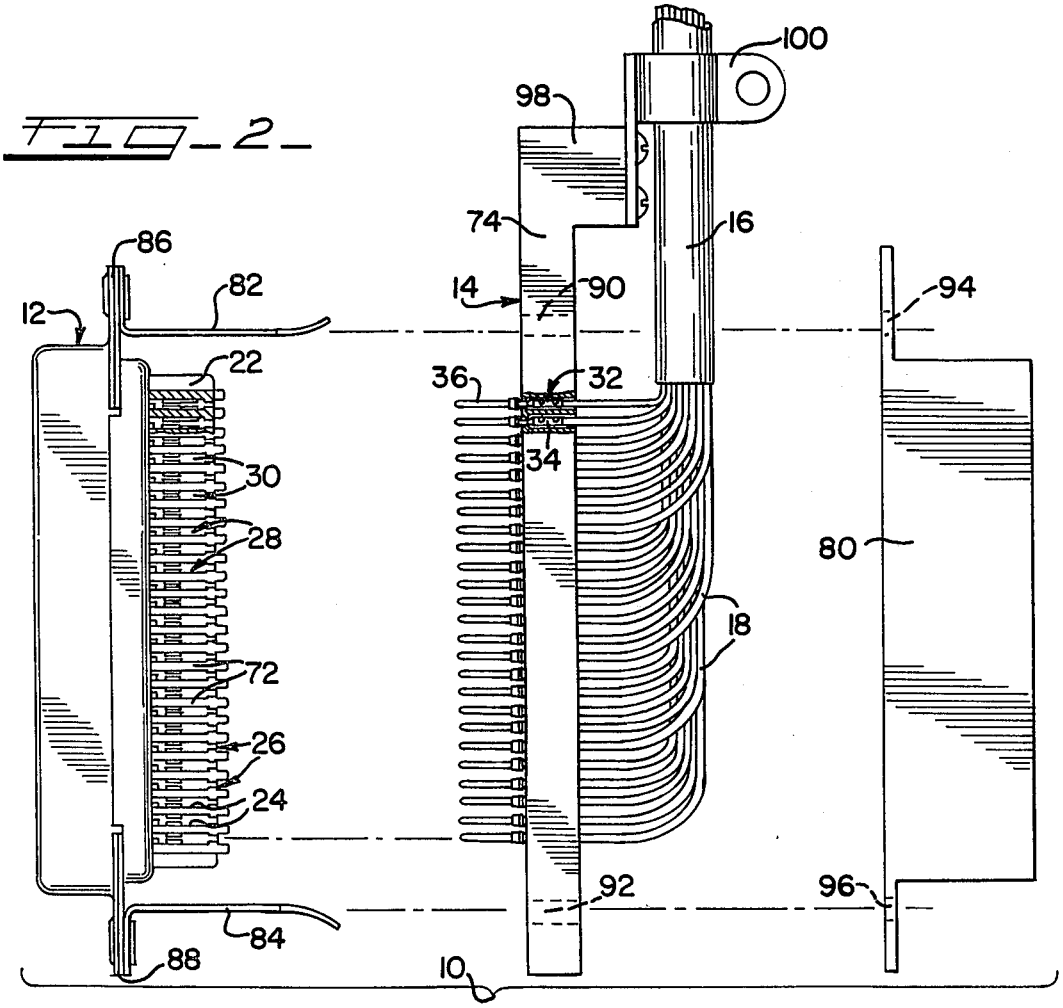

ELECTRICAL CONNECTOR TERMINATION SYSTEM FOR QUICK FIELD SERVICE

BACKGROUND OF THE INVENTION

This invention relates generally to means for terminating electrical conductors to multi-contact electrical connectors and more specifically to electrical connectors having a plurality of contact elements adapted to be terminated with pin contact members electrically secured to a plurality of insulated conductors. In particular, the present invention relates to an improved electrical connector termination system of the above type which utilizes an insulation-piercing pin/ribbon socket contact arrangement and improved means for releasably maintaining the electrical conductors and connector in a fully terminated condition.

The increasing practice, particularly in sophisticated electronics fields exemplified by the computer and telephone industries, to modularize and miniaturize electronic circuitry has brought on the problem of finding more efficient and reliable means for interconnecting and terminating individual circuit modules and cables containing plural insulated electrical conductors. Such interconnections should preferably be effected to facilitate rapid field termination and ready replacement or removal for servicing.

Recognizing these requirements, a wide variety of arrangements have been devised and employed to effect termination of plural insulation conductors with an electrical connector adapted to receive such conductors. In such multi-circuit electrical connectors, one common technique for terminating the individual conductors with the connector has been to strip the insulation from the end of the conductor and then solder the bare conductor end to a connector contact. This procedures requires considerable skill on the part of the workman making the solder connection, particularly in miniaturized connectors. There is also a tendency to bridge adjacent contacts of the connector during the soldering operation, producing undesired circuit connections.

Another widely utilized termination technique which has gained considerable acceptance entails the use of insulation-piercing terminals for the contact members of the connector. These terminals are adapted to cut through the insulation of the conductor and establish an electrical connection therewith without preliminary stripping and without the conventional soldering step. In multi-circuit electrical connectors, these insulation-piercing terminals frequently are in the form of ribbon contacts disposed within the connector housing.

In particular, U.S. Pat. No. 3,867,005, issued to Paul Hoppe, Jr., on Feb. 18, 1975, and U.S. Pat. No. 3,926,498, also issued to Paul Hoppe, Jr., on Dec. 16, 1975, both patents being assigned to the assignee of the present invention, disclose multi-circuit electrical connectors utilizing such insulation-piercing ribbon contact elements, the disclosures of which are specifically incorporated herein by reference. Referring to these patents, the insulated electrical conductors are securely terminated in a connector by forcibly inserting the insulated conductors transversely into longitudinally open channel-shaped contact elements disposed in the connector housing. These contact elements contain insulation-piercing notches whereby the notches penetrate the insulation and make electrical contact with the conductors. Furthermore, strain relief channels are provided in the connector housing at the open end of each contact element which, along with the insulation-piercing notches, aid in maintaining the termination connection between the insulated conductors and the connector.

While such connector termination systems are quite adequate for many purposes, there are certain instances whereby the transverse insertion of the insulated conductors into the connector's contact elements is either impossible or at least difficult. For example, in instances where such connectors are stacked in a row, as in telephone call box applications, termination by transverse insertion of the insulated conductors into the insulation-piercing elements of the electrical contacts is virtually impossible once the connectors have been stacked. Furthermore, large insertion tools are generally utilized for making such transverse connections, and this use of large tools in the field is difficult and cumbersome. Without the use of such specialized termination tools, however, transverse insertion of the conductors into the insulation-piercing contacts must be done by hand, one at a time, and this alternate method of connection is tedious as well as time consuming. Finally, it has been found that intermittency in operation sometimes occurs in connectors utilizing such insulation-piercing contacts when the terminated connectors have been subjected to severe vibration or rough handling.

SUMMARY OF THE INVENTION

Therefore, the present invention is directed to an improved termination system for multi-circuit electrical connectors which overcomes the above-mentioned deficiencies of prior means for terminating such electrical connectors.

Particularly, it is an object of the present invention to provide a termination system for multi-circuit electrical connectors which enables rapid and easy connection and disconnection between the connector components and the insulated conductors in the field.

It is another object of the present invention to provide an improved multi-contact electrical connector termination system which utilizes a connector contact arrangement whereby piercing of the conductor insulation by a connector contact element by way of transverse insertion is avoided.

A further object of the present invention is to provide an improved multi-circuit electrical connector termination system whereby the strain relief channels of the connector component's housing are utilized as part of an improved means for releasably maintaining the component parts of the connector and conductors in a fully terminated condition.

Accordingly, the present invention is directed to a multicircuit electrical connector termination system having a connector component and a termination component. The connector component includes a receptacle having a contact mount insert with a plurality of mounting cavities aligned in at least one row along a common plane, each mounting cavity having an inner and outer end. A ribbon contact member is disposed within each cavity and includes a terminal socket element located proximate to the cavity's outer end.

The termination component has at least one and preferably a plurality of pin contact members. Each pin contact member includes a terminal portion which is electrically engaged with at least one electrical conductor, and an active pin portion which is adapted for electrically terminating with a terminal socket element of one ribbon contact member. Preferably, the pin contact members are arranged to engaged and mate with the ribbon contact members as a single termination unit.

The termination system of the present invention also includes keying and locking means for releasably maintaining the connector and termination components in a fully terminated condition. The keying and locking means preferably include a narrowed channel disposed adjacent the outer end of each mounting cavity which ends in a restrictive guide orifice adapted to receive an active pin portion, at least one neck portion disposed about each pin contact member intermediate its terminal and active pin portions, and means lockingly engaging at least one neck portion of each pin contact member for releasably retaining the pin contact member in the terminated connector.

In one form of the invention, the means for lockingly engaging the neck portion includes an inwardly projecting embossment disposed adjacent the outer end of each mounting cavity, the embossment forming both the narrow entry channel and the restrictive guide orifice. In another embodiment of the invention, the termination component further includes a block member having a plurality of slots therein, each pin contact member being partially disposed within one of the slots. The means for lockingly engaging the neck portion includes a restrictive lip portion disposed at the outer end of each slot with the active pin portion of the pin contact member projecting outwardly from the block and cooperating with the narrow entry channel and the restrictive guide orifice. In a further embodiment of the invention, each pin contact member includes two neck portions, and the means for lockingly engaging at least one neck portion of each pin contact member includes both the inwardly projecting embossment of the mounting cavity and the restrictive lip portion of the slot, each engaging one of the two neck portions of the pin contact member.

The terminal portions of the pin contact members preferably include insulation-piercing and crimping members to physically and electrically engage the electrical conductors. In this manner, the crimping and piercing of the conductor insulation takes place prior to termination of the conductors with the electrical connector thereby permitting the connectors to be stacked without impeding the electrical termination of the conductors thereto. Furthermore, the present invention recognizes that the restrictive guide orifices of the connector component housing may be utilized to maintain the electrical conductors and the connector in a fully terminated condition.

BRIEF DESCRIPTION OF THE DRAWINGS

The novel features which are believed to be characteristic of the present invention are set forth in the appended claims. The invention itself, however, together with further objects and attendant advantages thereof, will become apparent and best understood by reference to the following detailed description taken in connection with the accompanying drawings, setting forth by way of illustration and example certain embodiments of the invention in the several figures of which like reference numerals identify like elements, and in which:

FIG. 1 is a side elevational view of one embodiment of an electrical connector terminated in accordance with the present invention, illustrating a conductor cable terminated thereto in its assembled state;

FIG. 2 is an exploded view of the embodiment illustrated in FIG. 1 with some parts in section;

FIG. 3 is an enlarged sectional view taken substantially along line 3—3 of FIG. 1;

DETAILED DESCRIPTION OF THE PREFERRED EMBODIMENTS

Figures 4, 5, 6, 7, 8, 9, 10, 15, 16:
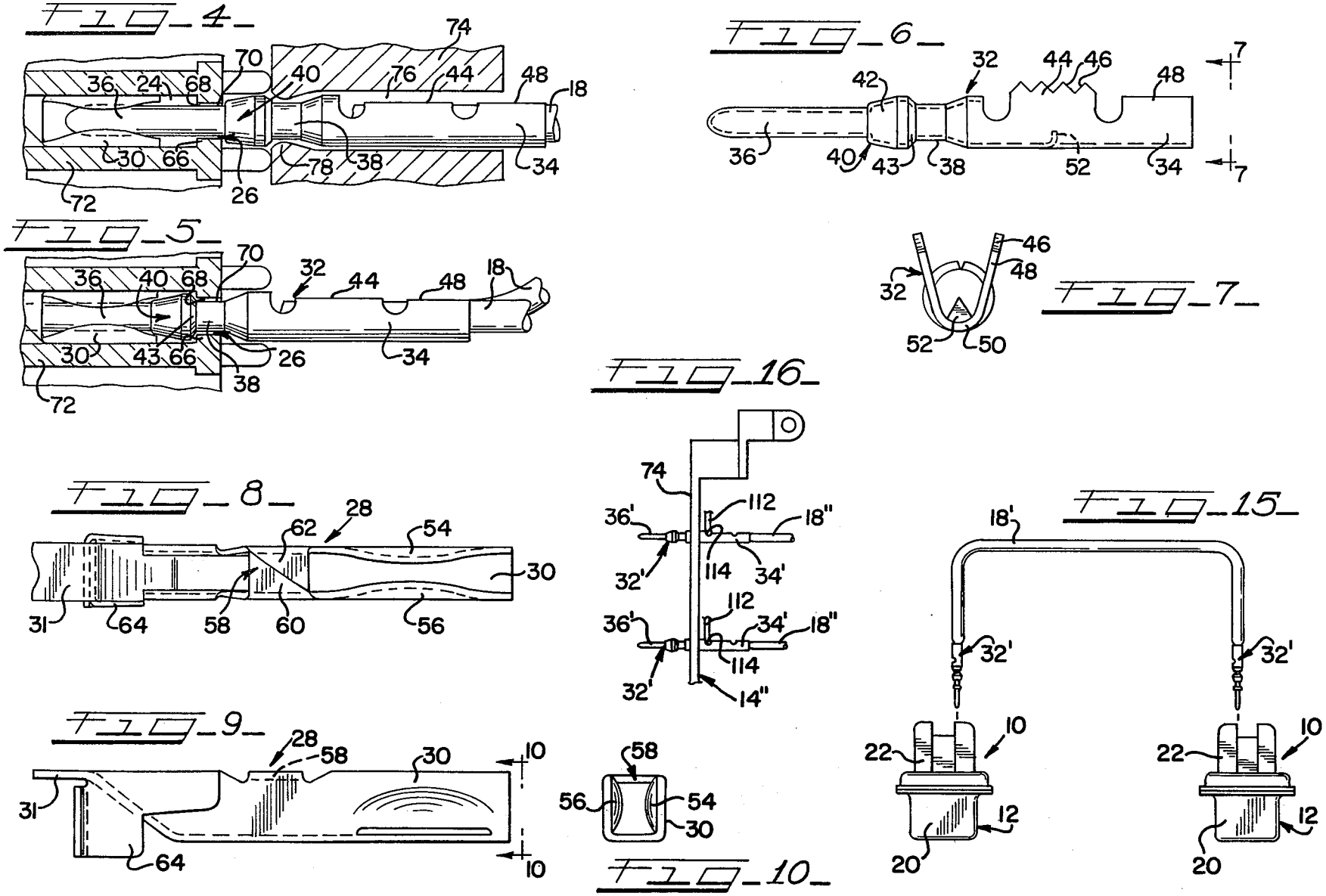
FIG. 4 is an enlarged, fragmentary sectional view, with some parts in elevation, illustrating the assembled pin contact member and terminal socket element of one embodiment of the present invention.
FIG. 5 is an enlarged, fragmentary sectional view, with some parts in elevation, of an assembled pin contact member and terminal socket element of a second embodiment of the present invention and illustrating two insulated conductors terminated in one socket element.
FIG. 6 is an enlarged side elevation view of a pin contact member constructed in accordance with the present invention and having one neck portion.
FIG. 7 is an elevational view taken substantially along line 7—7 of FIG. 6.
FIG. 8 is an enlarged, partial top plan view of a ribbon contact member constructed in accordance with the present invention.
FIG. 9 is a partial side elevation view of the ribbon contact member of FIG. 8.
FIG. 10 is an elevation view taken substantially along line 10—10 of FIG. 9.
FIG. 15 is a front elevation view illustrating the termination and interconnection of two electrical connectors in accordance with the present invention.
FIG. 16 is a side elevation view of the termination component of FIG. 2 but illustrating each insulated conductor secured to a pin contact member for only partial termination to one terminal socket element.

Referring to FIGS. 1 and 2, multi-circuit electrical connector termination means 10 includes a connector component 12 and termination component 14 adapted to electrically terminate a conductor cable 16 which preferably incorporates a plurality of individual insulated conductors 18. The connector component 12 includes a receptacle housing 20 which contains a dielectric contact mount insert 22. The insert 22 and the housing 20 may be constructed in any conventional manner such as disclosed in the patents incorporated herein by reference.

In a preferred form, the contact insert 22 contains at least one and preferably a plurality of elongated mounting cavities 24 which are arranged in at least one and preferably two rows along the length of the insert 22 on either side thereof, each row being aligned in a common plane. Each mounting cavity 24 extends the full depth of the insert 22 and opens at an outer end 26 and an inner end (not illustrated) enclosed within the housing 20. Disposed within each mounting cavity 24 is a ribbon contact member 28 which includes an active ribbon element 31 (FIGS. 8 and 9) and a terminal socket element 30 which is disposed proximate the cavity's outer end 26.

The termination component 14 includes at least one and preferably, as illustrated, a plurality of pin contact members 32. Each pin contact member 32 includes a terminal portion 34 adapted to electrically engage at least one of the individual insulated conductors 18, and an active pin portion 36 which is adapted to be inserted within and electrically terminate with a terminal socket element 30.

Referring to FIGS. 6 and 7 which illustrate one embodiment of the pin contact member 32 in detail, at least one neck portion 38 is provided along each pin contact member 32 intermediate its terminal portion 34 and its active pin portion 36. A knob 40 is disposed about the active pin portion 36 adjacent the neck portion 38 and preferably has a forward face 42 shaped in the form of a truncated cone inclined toward the free end of the active pin portion 36. This shape of the front face 42 facilitates easy insertion of the pin contact member 32 into the cavity 24. An annular shoulder 43, which joins the knob 40 to the neck 38, aids in removing the member 32 from the cavity 24.

Each terminal portion 34 includes two crimping members 44, each of which has a plurality of serrations 46 disposed along the longitudinal free edge thereof, and two gripping tabs 48, all of which are formed in a substantially U-shaped channel from the sidewalls of the terminal portion 34, as specifically illustrated in FIG. 7. Disposed along the base 50 of the terminal portion 34 is an upstanding barb 52. The serrations 46 and the barb 52 cooperate to pierce the insulated covering of a conductor 18 and make electrical contact therewith upon folding and crimping of the members 44 against a conductor 18. The gripping tabs 48, after they have been crimped against an inserted conductor 18 as illustrated in FIGS. 4 and 5, provide strain relief for the conductor 18 against stress or tension applied thereto. In this manner, the electrical connection is readily maintained between the terminal portion 34 and the electrical conductor 18. It should also be noted, as illustrated in FIG. 5, that more than one insulated conductor 18 may be secured to the terminal portion 34 of any one pin contact member 32.

Referring now to FIGS. 8–10, wherein the ribbon contact member 28 is illustrated in detail, the terminal socket element 30 preferably is in the form of a substantially U-shaped channel having inwardly arcuate sides 54, 56, and a partial top 58 which is formed from two abutting, folded tabs 60, 62. The socket element 30 is sized and shaped so as to snugly fit within the mounting cavity 24 proximate to the catity's outer end 26, as illustrated in FIGS. 4 and 5. The sides 54, 56 are bowed inwardly a sufficient amount to create a bias engagement with the active pin portion 36 of an inserted pin contact member 32. In this manner, the arcuate, resilient sides 54, 56 snugly maintain the pin contact member 32 with the terminal socket element 30 while making electrical contact therewith, the sides 54 and 56 further acting as wiping surfaces against the active pin portion 36.

The active ribbon element 31 of the ribbon contact member 28 is sized and shaped in any desired conventional manner, such as in the form of a Micro-Ribbon hook as illustrated in the incorporated patents, the term Micro-Ribbon being a registered trademark of the Bunker Ramo Corporation. The active ribbon portion 31 may also include a retainer element 64 which projects from the ribbon portion 31 to aid in securely maintaining the ribbon contact member 28 within the mounting cavity 24.

Referring particularly to FIGS. 3–5, means for keying and releasably locking the pin contact members 32 relative to the connector component 12 include an embossment 66 disposed at the outer end 26 of each mounting cavity 24. The embossment 66 is preferably in the form of an annular flange which projects inwardly toward the central axis of the mounting cavity 24 to form a channel 68 which is narrower than the cavity 24. The embossment 66 opens into the cavity 24 at one end and terminates at its outer end in a restrictive guide orifice 70. The orifice 70 and the channel 68 function together to guide and direct the active pin portion 36 into the terminal socket element 30.

In one embodiment of the present invention as illustrated in FIG. 5, the embossment 66 and the sidewalls 72, which separate the individual mounting cavities 24, have sufficient resiliency to yield to the knob 40 as it is forced through the channel 68 into the cavity 24. In this particular embodiment, the embossment 66 then lockingly engages the single neck portion 38 of the pin contact member 32 so as to releasably lock and maintain the member 32 in a terminated condition within the terminal socket element 30. The individual insulated conductors 18, which are separately secured to the pin contact members 32, are thus individually electrically terminated in the individual ribbon contact members 28 mounted within the insert 22.

In a second embodiment of the present invention as particularly illustrated in FIGS. 1, 2 and 4, the termination component 14 further includes a block member 74 which functions as a gang tool. The block member 74 includes a plurality of tubular slots 76, each slot 76 being sized and shaped to receive and maintain therein the terminal portion 34 of a pin contact member 32. Each tubular slot 76 has at its outer end a restrictive lip portion 78 which is substantially in the form of an annular flange projecting inwardly toward the central axis of the slot 76. As illustrated in FIG. 4, the restrictive lip portion 78 lockingly engages the single neck portion 38 of the pin contact member 32. The face 42 and the annular shoulder 43 of the knob 40 function relative to the tubular slot 76 in a manner similar to their function relative to the channel 68 in the previous embodiment.

It should be noted that in this second embodiment, the individual insulated conductors 18 are preferably first secured to the pin contact members 32 and are then inserted within the slots 76 so that the plurality of pin contact members 32 act as a gang when terminated with the ribbon contact members 30. The channels 68 and the orifices 70 merely function as keyways in this embodiment to guide the active pin portions 36. The block member 74 provides more positive alignment and termination of a gang of pin contact members 32 and enables the members 32 to be readily arranged in a predetermined manner. The block member 74 further increases the mechanical rigidity of the fully terminated connector assembly.

A cover 80 may be provided to protect the terminated electrical connections between the conductors 18 and the terminal portions 34. The cover 80 is sized and shaped to fit over the terminated ends of the conductors 18 and abut the surface of the block member 74. Two polarized bracket members 82 and 84 may also be employed to further insure proper locking engagement between the termination component 14, the connector component 12 and the cover 80, and to insure that any predetermined arrangement of insulated conductors 18 coded (color or numeral) relative to the ribbon contact members 28 is not inadvertently reversed when the connector component 12 and termination component 14 are interengaged. In the illustrated second embodiment, the connector housing 20 includes two end flanges 86 and 88, and the bracket members 82 and 84 are secured thereto by any conventional means such as a nut and bolt (not illustrated). Polarized apertures 90, 92 in the block member 72 and polarized apertures 94, 96 in the cover member 80 are provided for cooperating with the brackets 82 and 84 to secure them to the block member 74 and the cover 80. The brackets 82 and 84 are shaped and keyed to the shapes of the apertures 90–96 so that the termination component 14 with its cover 80 may only be mated with the connector component 12 in one manner, thereby insuring proper engagement and alignment. The bracket members 82 and 84 also aid in increasing mechanical rigidity of the terminated connector assembly as well as make the assembly less susceptible to inadvertent disengagement from externally applied forces.

As illustrated in FIGS. 1 and 2, the block member 74 may have an end member 98 and a clamping flange 100. The clamping flange 100 is sized and shaped so as to securely bind the cable 16 against movement relative to the block member 74. In this manner, the flange 100 provides strain relief for the cable 16 and the conductors 18.

Figure 11:
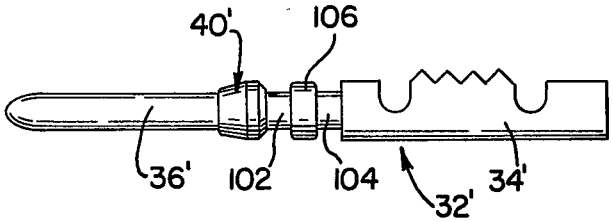
FIG. 11 is an enlarged side elevation view of a second embodiment of a pin contact member constructed in accordance with the present invention and having two neck portions.
Figure 12:
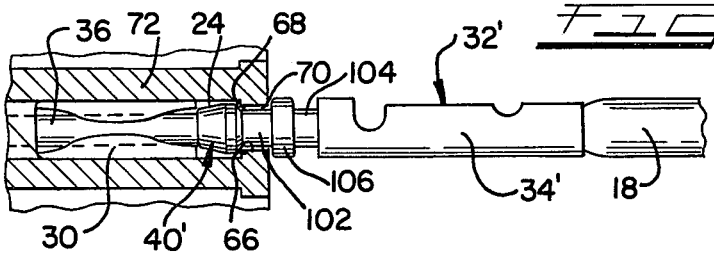
FIG. 12 is an enlarged, fragmentary sectional view, with some parts in elevation, of the pin contact member of FIG. 11 terminated in a terminal socket element and illustrating a third embodiment of the present invention.

Referring now to FIGS. 11 and 12, a second embodiment of the pin contact member 32' is illustrated having a terminal portion 34' and an active pin portion 36'. In this embodiment, two neck portions 102 and 104 are provided along each pin contact member 32' intermediate its terminal portion 34' and its active pin portion 36'. The neck portions 102 and 104 are separated by a collar 106, and a knob 40' is disposed about the active pin portion 36' adjacent the neck portion 102. The physical and functional interrelationships between the active pin portion 36', the knob 40' and the neck 102 are identical to those of the active pin portion 36, the knob 40 and the neck 38 of the previous embodiments.

FIG. 12 illustrates a third embodiment of the present invention utilizing the pin contact member 32' which is substantially identical to the embodiment illustrated in FIG. 5. In this third embodiment, the embossment 66 and the sidewalls 72 of the mounting cavity 24 yield to the knob 40' as it is forced through the channel 68 into the cavity 24. The embossment 66 then lockingly engages the forwardly disposed neck portion 102 of the pin contact member 32' so as to releasably lock and maintain the member 32' in a terminated condition within the terminal socket element 30. In this particular embodiment, the second neck portion 104 is not utilized in the final termination state.

Figure 13:
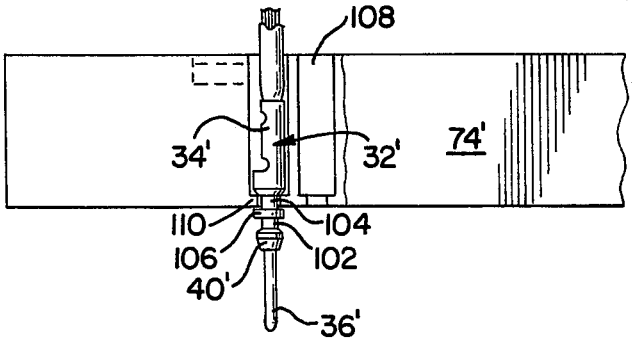
FIG. 13 is an enlarged, fragmentary side elevation view, with some parts in section, of the termination component of a fourth embodiment of the present invention.
Figure 14:
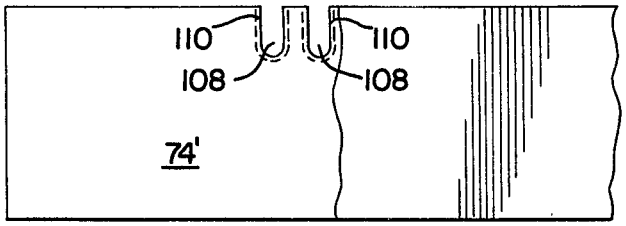
FIG. 14 is an enlarged, fragmentary top plan view of the block member of the termination component illustrated in FIG. 13.

Turning to FIGS. 13 and 14, yet another embodiment of the present invention is illustrated utilizing the pin contact member 32'. In this fourth embodiment, the termination component 14' includes a block member 74' which functions as a removable gang tool for loading and terminating one row of pin contact members 32'. The block member 74' includes a plurality of aligned, notch-like slots 108 along one longitudinal side thereof. Each slot 108 is sized and shaped to receive and temporarily maintain therein the terminal portion 34' of a pin contact member 32'. Each notch-like slot 108 has at its outer end a restrictive lip portion 110 which is substantially in the form of a U-shaped flange projecting inwardly toward the central axis of the slot 108.

As illustrated in FIG. 13, the restrictive lip portion 110 engages the neck portion 104 of the pin contact member 32' so that the forward neck portion 102 and the active pin portion 36' extend outwardly from the outer end of the slot 108 to engage a terminal socket element 30 in the manner illustrated in FIG. 12. When an entire row of pin contact members 32' is loaded in the block member 74' and then lockingly terminated as a unit with a row of terminal socket elements 30 in a connector component 12 (FIGS. 1 and 2), the block member 74' is then moved transversely to the axis of the terminated pin contact members 32' so as to disengage therefrom, resulting in a plurality of terminated pin contact members 32' as illustrated in FIG. 12.

It should be noted that the pin contact member 32' of FIG. 11 may be substituted for the pin contact member 32 of FIGS. 1 and 2 for use with the block member 74. In such an instance, the pin contact member 32' interacts with the block member 74 in the same manner as with the block member 74' except that the block member 74 is retained in place as part of the final termination component, whereas the block member 74' merely functions as a loading tool adapted to simultaneously terminate one row of conductors 18 to a connector component 12.

Referring to FIG. 15, it can be seen that a slight modification of the first or third embodiment of the present invention may be utilized whereby the insulated conductor is in the form of a jumper wire 18' which includes a pin contact member 32' at both ends thereof. The jumper wire 18' may be terminated to two different multi-circuit electrical connectors 10 in the manner previously illustrated thereby interconnecting the same. It should be noted that a plurality of such insulated jumper wires 18' may be used to terminate and completely interconnect the two individual connectors 10.

FIG. 16 illustrates yet another modification of the present invention wherein the termination component 14'' includes the block member 74 with at least one pin contact member 32' lockingly engaged therein. In this modification, each insulated conductor 18'' is secured to the terminal portion 34' of a pin contact member 32' but only for partial termination to a terminal socket element 39 (FIG. 11). To achieve this, the conductor 18'' is pierced and crimped to the terminal portion 34' substantially as heretofore described. However, the conductor 18'' is not terminated in a dead-end manner as previously illustrated but rather as a half-tap wherein an outlet extension 112 of the conductor 18'' passes through the orifice 114 in the terminal portion 34'. This outlet extension 112 is then itself terminated in a dead end to another socket element by another pin contact member.

As can be seen from the above detailed description, the present invention provides a number of advantages over prior termination systems for insulation-piercing connectors as well as alleviating the stated deficiencies thereof. The multi-circuit electrical connector termination system of the present invention takes advantage of the insulation-piercing concept but eliminates the problems inherent with termination by transverse insertion of the insulated conductors into insulation-piercing sockets disposed in the connector housing. With the present invention, the insulated conductors may be easily and individually secured to pin contact members so as to provide greater control over the insulation-piercing operation, and the use of large, combersome tools in the field is eliminated. Once the pin contact members are secured to the ends of the insulated conductors, they are easily and quickly terminated individually or as a gang into the terminal socket elements of the ribbon contact members which are predisposed within the connector component receptacle. This also aids in eliminating the use of large and cumbersome tools as previously required to force the insulation covered conductors into insulation-piercing sockets.

Furthermore, the keying and locking means of the present invention makes use of the strain relief holes in the connector housing insert to firmly and releasably maintain the connector and conductors in a fully terminated condition. Also, intermittency in operation which had occurred with the previous insulation-piercing design as a result of shock or rough handling of the terminated connectors is considerably decreased in that the insulated conductors may be more securely fastened to the pin contact members, and the pin contact members are firmly terminated and held in place in the connector by the keying and locking means of the present invention. Finally, the multi-circuit electrical connector of the present invention may be easily terminated in a limited amount of space.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

What we claim is:

1. An electrical connector termination system comprising:

a connector component defining a plurality of open ended, elongate mounting cavities therein and including a plurality of contact members disposed respectively in said cavities, each said cavity including a restrictive guide orifice defined by inner embossment means disposed proximate one open end thereof, each said contact member including a terminal socket element disposed within one said cavity inwardly of said embossment means; and a termination component including a support member defining at least one open ended, elongate slot therein with each said slot communicating longitudinally therealong with the exterior of said support member by a longitudinal side opening, said support member including inner restrictive lip means disposed in each said slot proximate the open end thereof, and a pin contact member at least partially disposed in each said slot and disengageable therefrom through said side opening, each said pin contact member including a terminal portion, an active pin portion for electrically and mechanically engaging within one said socket element and at least one neck portion intermediate said terminal and active pin portion for releasable engagement with one said restrictive lip means, each said active pin portion cooperating with one said restrictive guide orifice to releasably maintain said connector and termination components in a fully terminated condition, all said pin contact members being simultaneously disengageable from said support member after engagement within said socket elements.

2. The electrical connector termination system as described in claim 1, wherein said restrictive lip portion includes means for lockingly engaging said one neck portion when said pin contact member is inserted within said slot to releasably maintain said pin contact member in said block member.

3. The electrical connector termination system as described in claim 1, wherein said embossment means is disposed adjacent said open end and defines a channel for guiding and maintaining said active pin portion in alignment with said terminal socket element when said pin contact member is inserted into said cavity.

4. The electrical connector termination system as described in claim 38, wherein each said pin contact member includes two said neck portions separated by a collar, with one said neck portion adapted for engagement by said embossment means and said second neck portion adapted for engagement by said restrictive lip portion when said connector and termination components are in a fully terminated condition.

5. An electrical connector termination system comprising:

a connector component defining a plurality of open ended mounting cavities therein and including a plurality of contact members disposed respectively in said cavities, each said cavity including a restrictive guide orifice defined by inner embossment means disposed adjacent one open end thereof, each said contact member including a terminal socket element disposed within one said cavity inwardly of said embossment means;

a termination component including a support member and at least one pin contact member, each pin contact member including a terminal portion secured within said support member, an elongate active pin portion projecting from said support member for electrically and mechanically engaging within one said socket element, and at least one neck portion intermediate said terminal and active pin portions for disposition within said restrictive guide orifice and engagement with said embossment means to firmly releasably secure said connector and termination components in a fully terminated condition, and wherein said support member comprises a block member defining a plurality of slots therein, each said pin contact member being at least partially disposed within one said slot, and said slot being open to the side of said support member transversely of the axis of the pin contact member disposed therein.

6. The electrical connector termination system as described in claim 5, wherein each said pin contact member includes two said neck portions spaced apart from each other, and wherein said block includes a restrictive lip portion disposed adjacent the outer end of each said slot adapted to engage one said neck portion, said embossment means being adapted to engage the other said neck portion disposed adjacent said active pin portion when said connector and termination components are in a fully terminated condition, each said slot communicating longitudinally therealong with the exterior of said block member through a longitudinal side opening sized and shaped to permit engagement and disengagement of one said pin contact member within said slot.

7. The electrical connector termination system as described in claim 6, wherein said block member defines said slots for simultaneous disengagement of said pin contact member.

8. An electrical connector termination system comprising:

a connector component defining a plurality of open ended mounting cavities therein and including a plurality of contact members disposed respectively in said cavities, each said cavity including a restrictive guide orifice defined by a transversely disposed lip adjacent one open end thereof, each said contact member including a terminal socket element disposed within one said cavity inwardly of said lip, and a termination component including a mounting block and at least one pin contact member, each pin contact member including a terminal portion secured within said mounting block to retain the pin contact member in the mounting block, an elongate active pin portion projecting from said mounting block for electrically and mechanically engaging within one said socket element and two neck portions spaced from each other and intermediate said terminal and active pin portions and exposed exteriorly of said mounting block for disposition within said restrictive guide orifice and in engagement with said lip to firmly releasably secure said connector and termination components in a fully terminated condition solely by engagement between said neck portions of said pin contact member and said lip of said mounting block of said termination component, and wherein said support member comprises a block member defining a plurality of slots therein, and wherein each said pin contact member is at least partially disposed within one said slot, said block member including a restrictive lip portion disposed adjacent the outer end of each said slot adapted to engage one said neck portion, said lip being adapted to engage the other said neck portion disposed adjacent said active pin portion when said connector and termination components are in a fully terminated condition, said slot communicating longitudinally therealong with the exterior of said block member through a longitudinal side opening sized and shaped to permit engagement and disengagement of one said pin contact member within said slot.

9. The termination system as described in claim 8, wherein said block member defines said slots for simultaneous disengagement of said pin contact members.

* * * * *